US006957672B2

(12) United States Patent
Taylor et al.

(10) Patent No.: US 6,957,672 B2
(45) **Date of Patent: *Oct. 25, 2005**

(54) METHOD FOR ENSURING THAT COATING COMPOSITIONS HAVE CORRECT COLOR

(75) Inventors: Celia Charlotte Taylor, Windsor (GB); Ian David Oakes, Reading (GB)

(73) Assignee: Imperial Chemical Industries plc, (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/767,607

(22) Filed: Jan. 29, 2004

(65) Prior Publication Data

US 2004/0250873 A1 Dec. 16, 2004

Related U.S. Application Data

(63) Continuation-in-part of application No. 10/024,938, filed on Dec. 19, 2001, now Pat. No. 6,701,977.

(30) Foreign Application Priority Data

Jul. 25, 2001 (GB) ..... 0118085

(51) Int. Cl.[7] ..... B65B 1/30
(52) U.S. Cl. ..... 141/83; 141/9; 141/104
(58) Field of Search ..... 141/9, 18, 83, 141/94, 100, 104, 192; 222/52, 77, 144.5, 222/145.1

(56) References Cited

U.S. PATENT DOCUMENTS

| | | | | |
|---|---|---|---|---|
| 4,836,685 | A | 6/1989 | Verreault | |
| 5,268,849 | A | 12/1993 | Howlett | |
| 6,053,218 | A | 4/2000 | Boers | |
| 6,637,471 | B2 * | 10/2003 | Luehrsen et al. | 141/83 |

FOREIGN PATENT DOCUMENTS

| | | |
|---|---|---|
| EP | 0 099 252 | 1/1984 |
| EP | 0 391 286 | 10/1990 |
| EP | 0 612 558 | 8/1994 |
| WO | WO - 99/11474 | 3/1999 |

* cited by examiner

*Primary Examiner*—Justine R. Yu
*Assistant Examiner*—Peter deVore
(74) *Attorney, Agent, or Firm*—Kenneth J. Stachel

(57) ABSTRACT

A method suitable for use in small trade stores or retail shops for assisting in providing the correct color or coating compositions mixed in the store or shop in which colorants (II) are added to a base paint (2), the base paint (2) being provided in a lidded container (I). The base paint (2) is pre dispensed in a lidded container (I), thereby avoiding the need to weigh it accurately in store thus saving time. Further time is saved by adding the colorants simultaneously to the base paint (2). The actual load (usually the combined weight of the can and the contents) is compared to the correct load stored in a database and the operator is alerted if the two fail to match.

16 Claims, 1 Drawing Sheet

METHOD FOR ENSURING THAT COATING COMPOSITIONS HAVE CORRECT COLOR

Figure 1:
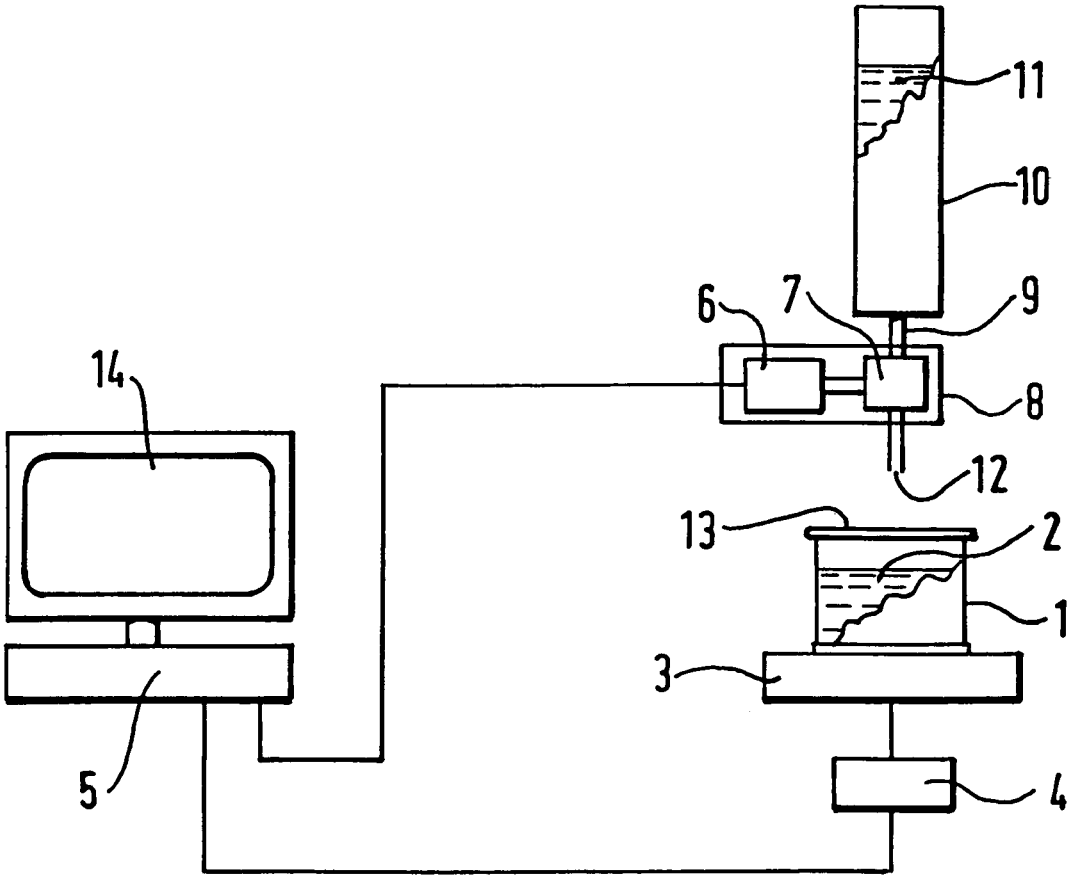

This application is a continuation in part patent application of application entitled "Tinting Machine for Coating Compositions, Especially Paints" Ser. No. 10/024,938 filed Dec. 19, 2001 now having U.S. Pat. No. 6,701,977.

This invention relates to a method suitable for use in small trade stores or retail shops for ensuring that coating compositions have the correct color, especially those coating compositions derived from base paints which are available in closed containers such as lidded cans. The invention also relates to a tinting machine, system suitable for use in performing the method in a small trade store or retail shop.

Colored paints are used by both skilled professional decorators who generally buy paint in trade stores and by relatively unskilled do-it-yourself painters who generally buy paint in retail shops. As consumers have become increasingly sophisticated and individual in their choice of colors, they have begun to demand a wider range of colors and their ability to detect even small differences in shades of color has also increased. This presents a problem to the paint manufacturer because he has to produce many colors in small amounts thus losing the economies of scale whilst the storekeeper/retailer has the problem of providing additional space to store in order to display this plethora of colored paints and both the paint manufacturer and the storekeeper/retailer have the problem of ensuring that the paint has the correct color.

Some paint manufacturers have addressed this problem by increasing and developing the use of tinters. These operate on the basis that a variety of colors can be made in the storekeeper's/retailer's premises by adding colorant to a factory-produced base paint. Usually a small number of different alternative colored base paints (three to six) are provided by the manufacturer to span a range of light to deep shades of finished colors.

Such base paints are unfinished from the point of view of the final correct color and they are generally provided in lidded cans which of course have to be unlidded (ie opened) before coloring (ie tinting) can begin.

The colorant usually takes the form of pigment concentrates, tinters or dyes. Usually, from 9 to 25 (preferably about 12 to 16) of such colorants are required to produce a full range of correct paint colors, although only three or four are normally required to produce any particular color.

Available time is very limited in a trade store or retail shop, so in practice colorants have to be added simultaneously. The colorants are added to the base paint according to one of a number of predetermined recipes for alternative colors which number of recipes constitutes a database stored for example in a computer which governs the operation of the method. The recipe also indicates which of the alternative base paints should be selected for tinting in order to produce a particular correct color.

Such tinting machine systems typically comprise a number of storage vessels containing the colorants, a positive displacement means (for example one or more manual or automated pumps) for delivering the colorant to the can of base paint, storage means for database of colorant recipes and control means (manual and/or computerised) for governing the delivery of colorant in accordance with the selected recipe. The control means may for example control the addition of colorant by governing the traverse of pistons in pumps or by activating the pumps for a predetermined period of time so that a predetermined volume of colorant is delivered in accordance with the recipe for a particular color.

In this way alternative amounts of each colorant may be added to a base paint enabling paints of a variety of alternative colors to be produced. Finally, the base paint containing its added colorant is subjected to mixing (usually by intense shaking), to obtain a homogeneous mixture of base paint and colorant having a highly uniform correct color.

A problem with tinting machine systems, however is that the correctness of the color of the final paint depends critically on the amount of each of the colorants added to the base paint. When a colorant is added using a pump driven by a motor, the number of turns or steps of the motor governs the quantity of colorant being added. This relationship is determined by measurements taken at the time of assembly of the machine and it is used to calibrate the pump. However, for various reasons, this calibration can change over time. For example, because pigments are generally very hard materials, the pump mechanism will wear with use, resulting in additions being made which are not in accordance with the recipe. Even when the pumps are operating correctly, an incorrect amount of colorants may be added, if, for example the nozzles through which the colorants exit into the can of base paint are partially or fully blocked. This results in an incorrect tint causing the resulting paint to have an incorrect color and consequently be discarded. Even worse, if the variation from the recipe is small, the incorrect tint may pass unnoticed until the paint has been applied. This inevitably requires a surface to be repainted with the correct color causing a very significant additional expense and inconvenience. Other causes of incorrect tinting are many and include defective pumps, leaky pipework and empty tinter vessels.

Because tinting machine systems are designed to be capable of producing many different colors, it is very difficult for an operator to notice when a particular color has been incorrectly tinted simply by looking at the mixed paint. Consequently, many colors may be incorrectly tinted before it comes to the operator's attention. Clearly some automated method is needed to ensure that paints tinted in trade stores or retail shops have the correct color.

United States patent Specification U.S. Pat. No. 5,268,849 published in 1993 discloses a tinting plant suitable for making colored paints in a factory. In the factory, as opposed to in a store or shop, the colorants are added one at a time to an empty or substantially empty can and then a base paint is added to the can from a bulk reservoir. This enables the change in weight of the can and contents to be used to govern accurately the addition of the colorants. Accuracy is possible because although the weights of each colorant added is small requiring sensitive weighing, they can be determined before the addition of the large weight of base paint which (because the weight is large) might hide a significant error in the weight of a colorant. It should also be remarked that accurate weighing is easier to achieve under factory conditions where operators will be more skilled and weighing means will be more regularly re-calibrated. Therefore, the method of U.S. Pat. No. 5,268,849 requires the base paint to be added to the can after the addition of the colorants which means that at least one bulk reservoir of base paint must be located near to the tinter which is a requirement which would not be practical in a small store or shop where space is at a premium.

Even if space could be available, the need to deliver a large volume of base paint to the can would make the tinting process too slow for realistic use in a store or shop.

It is an object of this invention to provide a method for ensuring that coating compositions have the correct color which method is suitable for use in a small trade store or retail shop. Another object is to provide a method to detect whether or not the correct base paint has been selected. A further object is to provide a tinting machine system for use in performing the method.

Accordingly, this invention provides a method suitable for use in small trade stores or retail shops for assisting in providing the correct color for coating compositions in which a) a container of base paint is placed on weighing device or member, b) colorants are simultaneously dispensed into the container, c) a load (usually the combined weight of the container and contents) on the weighing device is determined wherein d) the load is compared with data in a database, each datum being a correct load for a particular color for the coating composition, e) the absence of a match between the load and a datum in the database is detected and optionally f) an alarm is sounded or the container and contents are rejected if the absence of a match is detected.

Although the weighing of the colorants and the base paint together produces a less sensitive load determination, it has been found that provided the load as determined by the weighing device is used only for comparison with carefully measured data in the database as opposed to being used to govern positively the addition of colorants to the base paint, then the comparison is sufficiently accurate to detect incorrect colors. The load will usually be the weight of the container and its contents, but the weight of the container might be tared so as to allow the method to work equally with containers made from differing materials such as metals or thermoplastics.

The invention also provides a tinting machine system suitable for use in small trade stores or retail shops and capable of ensuring that coating compositions colored using the tinting machine system have the correct color in which the tinting machine system includes a) weighing member on which an open container of coating composition can be located and which is able to determine the load on the weighing member, b) at least one reservoirs for containing colorants, c) at least one positive displacement member for delivering a plurality of colorants simultaneously from reservoirs into the container, wherein the tinting machine system also includes d) at least one processing member having at least one storage member in which is stored at least one database in which each datum is a correct load for a particular color for the coating composition, e) the same or different processing member having a comparitor for comparing the load after delivery of the colorants into the container with data in the database, f) at least one signaling member to indicate the absence of a match between the load and a datum in the database and optionally g) at least one alarm or rejection member which is activated when there is an absence of a match.

As used herein, spatial or directional terms, such as "vertically", "left", "right", "inner", "outer, and the like, relate to the invention as it is shown in the drawing figures. However, it is to be understood that the invention may assume various alternative orientations and, accordingly, such terms are not to be considered as limiting. Further, as used herein, all numbers expressing dimensions, physical characteristics, quantities of ingredients, reaction conditions, and the like used in the specification and claims are to be understood as being modified in all instances by the term "about". Accordingly, unless indicated to the contrary, the numerical values set forth in the following specification and claims may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10.

For both the method for ensuring that coating compositions have the correct color and the tinting machine system suitable non-exclusive examples of weighing devices or members for determining the load include mechanical balances and load cells. A load cell is a device which produces an output signal proportional to the load or force it is experiencing always provided that the load or force is within the range of operation of the cell.

Such load cells rely on the piezo-electric effect characteristic of certain crystals, whereby a current is generated in proportion to the pressure or weight applied to it. Load cells are preferred as they are better able to register a wide range of loads accurately. This is important in detecting incorrect colors which can range from light colors requiring a small addition of colorant to deep colors requiring significantly more colorant to be added.

Preferably, the at least one signalling member which detects the absence of any match between the load and the data in the database adapts the input from the weighing member to a signal that is readable by at least one processing member or device employed to compare the load and the data in the database. This signal provided to the processing member may be of various types, including electrical, optical or radio wave. Such signals may be in analogue or digital format. The digital format is preferred as the processing member which are conveniently available usually operate in digital format themselves. Suitable analogue signalling members may include an analogue to digital converter so as to permit operation with the processing member.

Depending on the nature of the signal provided by the signalling member, the signal may be transmitted through electrically conducting wires, fibreoptic wires or air. Transmission through electrically conducting wire is preferred. More preferably the signal is transmitted through fibre-optic wire as it is less likely to suffer interference from extraneous sources.

The combination of at least one storage member capable of storing the database and at least one comparitor for comparing the load as determined by the weighing member with the data in the database constitute a processing member. The one or more processing member may be provided by a computer, suitable examples of which include a personal computer, be it a desk top or lap top version, a hand held computer or a server. The processing member may communicate with the associated parts of the tinting machine system from a remote location via the internet, direct telephone, cable or other connection. Alternatively, it may be connected locally allowing direct communication between the processing member and the tinting machine system. However, no matter where it is located, the processing member is an important part of the tinting machine system. Preferably the processing member is a personal computer connected locally; or a server or personal computer which communicates from a remote location using a connection as hereinbefore described.

The at least one processor can be one processor having both at least one member for storing of the database and at least one comparitor, or two processors can be used where one processor has the storage member and the other processor has the comparitor. In the latter alternative configuration a communication member such as those for connecting processors for communication together can be used to connect the processors.

The signalling member is activated when the load does not match any datum in the database. In a modification of this invention, the signaling member may be activated when the load does in fact match a datum in the database so providing a negative warning in that it is the absence of a signal which ensures that an incorrect color is noticed and alerts the operator.

The signaling member may activate audible devices such as buzzers, bells and whistles or visual devices such as a light or a warning message displayed on a user interface such as a visual display unit or television monitor. The signaling member may activate rejection member which displace the container of coating composition from the tinting machine system before the contents of the container are mixed by shaking.

Generally for each color offered, the database stored in the storage member will record a color recipe including information indicating i) which base paint, and its load, should be used in producing a particular color, ii) the amount of each colorant to be added and iii) the final load which of course is a datum in the database.

Since consumers purchase paint in containers of various sizes according to their needs, the database also contains information on the correct size of the container of base paint as well as the base paint itself. Typical container sizes such as cans of base paints tinted in retail stores vary from 1 liter to 20 liters (0.264 gallon to 5.28 gallons The amount of colorant may be specified by weight or volume. The colors may be identified by name, code or cypher or combinations thereof, for example British Standard names or codes, or RAL codes, NCS (Natural Color System) cyphers, "Pantone"referencesor "Dulux" "Color Palette" names or cyphers.

The loads and color recipes and identifiers can be recorded in various forms. Preferably they are recorded systematically or methodically and are individually accessible to form a database which enables additions and deletions to be more readily made. The collection of recipes may be stored on storage member, suitable examples of which include magnetic floppy disks or hard disks, optical disks such as a CD ROM and Digital Versatile Disk (DVD). The storage member may be local to or remote from the processing member.

Non-exclusive examples of suitable colorants include pigments, pigment concentrates and dyes.

Pigment concentrates generally comprise high levels of pigment, dispersed in a carrier liquid, optionally with the aid of dispersant. The carrier liquid may be an organic solvent or water or mixtures thereof. Solutions of dyes in appropriate solvents or undiluted dyes are also useful. Pigment concentrates are preferred as they provide better hiding power than dyes.

The base paint comprises all the necessary components of a coating composition including pigment, binder, carrier liquid, solvent, dispersant, antifoam, coalescing aid and other additives typically found in coating compositions. The base paint is distinguished from the final tinted coating composition mainly because it does not contain all of the required colorants to produce a particular color contained in the collection of color recipes.

The number of base paints required is generally from 3 to 8. Preferably from 4 to 6 are used as this reduces the risk of selecting the wrong base paint for tinting whilst maintaining acceptable capability in producing the necessary range of colors.

From 9 to 25 colorants are required to produce the range of colors using the base paints. Preferably from 12 to 16 are used as this results in a simpler tinting machine system.

Where (as is usually the case) more than one colorant is required to achieve the tinted coating composition, the colorants are added simultaneously in order to achieve a speed of tinting suitable for a trade store or retail shop. It is, however, desirable for each colorant to be added using its own dedicated dispenser as this minimises the risk of contamination of one colorant by another.

The at least one or more reservoirs (ie storage capacity) for the colorants can be provided by preferably cylindrical vessels, typically contained within the tinting machine for convenience.

The tinting machine system provides accommodation for the container of base paint whilst the colorant is added. For example this can be a shelf.

Preferably the accommodation should be of sufficient size to accommodate the weighing member and the container together. This saves time in the tinting process by allowing the addition of colorant and subsequent determination of the load to be performed in a consecutive operation.

The addition of colorant to the base paint is carried out using a positive displacement colorant dispenser. Suitable examples of a colorant dispenser include a pump, preferably a piston pump, driven by a motor or a syringe driven by a motor. Stepper motors are preferred as they can be accurately controlled thereby delivering precise quantities of colorant via the pump. Even more preferably, the colorant dispenser is controlled by the processing member.

Also the one or more processors for the tinting machine system can have software that can be divided into more than one section for instance two sections. The first section of software can contain the color recipes and associated instructions to the hardware (for example the motors driving the pumps, various valves an the like). This section of software can be written in any suitable language or code known to those skilled in the art such as Microsoft Visual Basic as text files. The recipe and associated instructions can be sent to another or second section of the software which can be the hardware driver which puts the instructions into effect; that is causes the pumps to add the specified amount of colorant(s). This driver can be a standard piece of software and is analogous to a printer driver.

A further cause for the color of the final paint being incorrect is that the operator has selected a container of base paint not in accordance with the stored recipe, rather than the result of an incorrect amount of colorant added. Since the containers of base paints are filled to different levels according to which shade of base paint they contain, each base paint can be distinguished from the others by weight. In addition, the various base paints contain differing amounts of pigments of different density which further contribute to weight differences. Consequently, in a variation of the method for detecting tinting errors, the tinting machine system of the invention can also be used to detect whether or not the weight of the container of base paint matches the corresponding weight stored in the collection of color recipes, before colorant addition begins.

Accordingly, there is provided a method to detect whether or not the correct base paint has been selected for tinting in which a) a container of base paint is placed on weighing member b) a load due to the base paint is determined and compared to the correct load of base paint in the database for the selected color c) the absence of a match between the determined load and the correct load is detected and an alarm sounded.

The invention is further illustrated by the following preferred embodiment described with reference to the drawing which is a diagrammatic representation of a tinting machine system also showing an open container in partial section.

The drawing shows an open unlidded can (1) almost fully filled with base paint (2) situated on a load cell (3). The load cell is connected to an analogue to digital converter (ADC) (4), which signals in digital format to a computerised processing member (5) any load registered by load cell (3). The computerised processing member (5) has stored on its hard disk (not shown) data forming a database. The computerised processing member (5) also communicates with a stepper motor (6) that drives a positive displacement pump (7) which communicates via pipework (9) with a storage vessel (10) containing colorant (11). Only one storage vessel (10) is shown but twelve are present. Outlet (12) from storage vessel (10) is located vertically above open mouth (13) of can (1) so that additions of colorant can be conveniently made to base paint (2). Computerised processing member (5) is further connected to visual display unit (14) to which messages can be signalled and displayed.

In operation, colorants (11) are dispensed from storage vessels (10) into can (1) to create a load which is weighed by load cell (3). The load is compared by processing member (5) with data in the database and if a match is not made with any datum in the database, then a message is signalled by processing member (5) to display unit (14) on which itis displayed to alert an operator to the failure to produce a correct color.

We claim:

1. A method for assisting in providing the correct color for coating compositions, comprising:

a) providing a container of base paint on a weighing member (3), b) simultaneously dispense more than one colorant into the container (1), c) determine the load on the weighing member (3) wherein d) the load is compared with data in a database, each datum being a correct load for a particular color for the coating composition, e) the absence of a match between the load and a datum in the database is detected and f) an alarm is sounded or the can and contents are rejected if the absence of a match is detected.

2. A method according to claim 1 wherein at e) the presence of a match between the load and the datum in the database is detected and optionally an alarm is sounded.

3. A method according to claim 1 wherein the load is determined using a load cell.

4. A method according to claim 2 wherein the load is determined using a load cell.

5. A tinting machine system for assisting in providing the correct color for coating compositions, comprising:

a) weighing member (3) on which an open containter (1) of coating composition can be located and which is able to determine the load on the weighing member (3), b) reservoirs (10) for containing colorants (11), c) positive displacement members for delivering a plurality of colorants (11) simultaneously from reservoirs (10) into the container (1), d) at least one processor (5) having at least one storage member in which is stored a database in which each datum is a correct load for a particular color for the coating composition, and having a comparitor for comparing the load after delivery of the colorants (11) into the container (1) with data in the database, e) signaling member to indicate the absence of a match between the load and a datum in the database; and f) an alarm or rejection member which is activated when there is an absence of a match.

6. A tinting machine system according to claim 5 wherein the weighing member (3) is a load cell.

7. A tinting machine system according to claim 5 wherein the positive displacement member (7) is a piston pump.

8. A tinting machine system according to claim 6 wherein the positive displacement member (7) is a piston pump.

9. A tinting machine system according to claim 5 wherein the processing member (5) is a computer.

10. A tinting machine system according to claim 6 wherein the processing member (5) is a computer.

11. A tinting machine system according to claim 7 wherein the processing member (5) is a computer.

12. A tinting machine system according to claim 5 wherein the at least one processing member (5) is located remotely from associated parts of the tinting machine system.

13. A tinting machine system according to claim 6 wherein the at least one processing member (5) is located remotely from associated parts of the tinting machine system.

14. A tinting machine system according to claim 7 wherein the at least one processing member (5) is located remotely from associated parts of the tinting machine system.

15. A tinting machine system according to claim 12 wherein the processing member (5) communicates from a remote location to the tinting machine system via the internet, direct telephone, cable or other connection.

16. The method according to claim 1 wherein the method is used to detect whether or not the correct base paint has been selected for tinting in which a) a can containing base paint (2) is placed on weighing member (3) b) a load due to the base paint (2) is determined and compared to the correct load of base paint in the database for the selected color c) the absence of a match between the determined load and the correct load is detected and an alarm sounded.

* * * * *